US011414893B2

(12) United States Patent
Eley et al.

(10) Patent No.: US 11,414,893 B2
(45) Date of Patent: Aug. 16, 2022

(54) EMERGENCY ACCESS PRIVACY LOCK AND ACCESS KEY

(71) Applicants: Ryan Eley, Tustin, CA (US); Michael Paxton, Santa Ana, CA (US); Renere Lopez, Santa Ana, CA (US)

(72) Inventors: Ryan Eley, Tustin, CA (US); Michael Paxton, Santa Ana, CA (US); Renere Lopez, Santa Ana, CA (US)

( * ) Notice: Subject to any disclaimer, the term of this patent is extended or adjusted under 35 U.S.C. 154(b) by 0 days.

(21) Appl. No.: 16/706,309

(22) Filed: Dec. 6, 2019

(65) Prior Publication Data

US 2020/0115928 A1 Apr. 16, 2020

Related U.S. Application Data

(63) Continuation of application No. 14/952,731, filed on Nov. 25, 2015, now Pat. No. 10,533,347.

(60) Provisional application No. 62/084,467, filed on Nov. 25, 2014.

(51) Int. Cl.

| | |
|---|---|
| ***E05B 65/10*** | (2006.01) |
| ***E05C 21/00*** | (2006.01) |
| ***E05B 63/00*** | (2006.01) |
| ***E05C 1/16*** | (2006.01) |
| ***E05C 1/08*** | (2006.01) |
| ***E05C 1/10*** | (2006.01) |

(52) U.S. Cl.

CPC ..... *E05B 65/1086* (2013.01); *E05B 63/0069* (2013.01); *E05B 65/1093* (2013.01); *E05C 1/085* (2013.01); *E05C 1/10* (2013.01); *E05C 1/163* (2013.01); *E05C 21/00* (2013.01)

(58) Field of Classification Search

CPC .... E05B 55/005; E05B 13/004; E05B 13/105; E05B 15/0033; E05B 2009/046; E05B 65/1086; E05B 63/22; E05B 65/1065; E05B 63/0069; E05B 65/1093; Y10T 292/0986; Y10T 292/57; Y10T 70/5451; Y10T 70/5496; Y10T 292/93; E05C 1/163; E05C 1/085; E05C 1/10; E05C 21/00; Y10S 292/37

See application file for complete search history.

(56) References Cited

U.S. PATENT DOCUMENTS

| | | | | | |
|---|---|---|---|---|---|
| 1,579,457 | A * | 4/1926 | Schlage | E05C 1/163 | 292/164 |
| 2,038,907 | A * | 4/1936 | Schlage | E05C 1/163 | 292/169.22 |
| 2,193,349 | A * | 3/1940 | Schlage | E05B 13/004 | 70/480 |
| 2,226,499 | A * | 12/1940 | Ledin | E05C 1/163 | 70/216 |
| 2,266,086 | A * | 12/1941 | Schlage | E05B 45/083 | 200/61.68 |
| 2,666,320 | A * | 1/1954 | Teich | E05C 3/165 | 70/474 |

(Continued)

*Primary Examiner* — Mark A Williams

(74) *Attorney, Agent, or Firm* — Welsh Flaxman & Gitler, LLC

(57) ABSTRACT

A safety lock and access key for doors that otherwise need to remain locked comprising a lock body containing a spring biased catch extending from one end of the body to engage in a keep of the door frame, a lever for moving the catch into the body to unlock the door, and a tool for unlocking locked doors.

2 Claims, 5 Drawing Sheets

(56) References Cited

U.S. PATENT DOCUMENTS

| | | | | | |
|---|---|---|---|---|---|
| 2,831,336 | A | * | 4/1958 | Schlage | E05B 55/005 70/479 |
| 3,018,651 | A | * | 1/1962 | Morrison, Jr. | E05B 59/00 70/468 |
| 3,385,622 | A | * | 5/1968 | Winger | E05C 1/14 292/170 |
| 5,157,953 | A | * | 10/1992 | Hung | E05B 63/22 292/170 |
| 5,301,526 | A | * | 4/1994 | Fann | E05B 55/005 292/169.17 |
| 5,598,726 | A | * | 2/1997 | Cordle | E05B 55/005 292/336.3 |
| 5,794,472 | A | * | 8/1998 | Kester | E05B 13/108 292/DIG. 27 |

* cited by examiner

Schlage

Schlage Retro Tool

EMERGENCY ACCESS PRIVACY LOCK AND ACCESS KEY

RELATED U.S. APPLICATION DATA

This application is a continuation of U.S. patent application Ser. No. 14/952,731, filed Nov. 25, 2015, which claims the benefit of U.S. Provisional Patent Application No. 62/084,467 filed on Nov. 25, 2014, the disclosures of the foregoing applications are hereby incorporated by reference in their entirety.

FIELD OF THE INVENTION

The invention relates generally to the field of locks, locking mechanisms, locking devices.

BACKGROUND OF THE INVENTION

The locking of door and cabinets is an essential aspect of maintaining safe homes and work places. Depending upon the circumstances involved it may be necessary to make doors and cabinets immediately unlockable in the event someone becomes incapacitated or accidentally locked where precious seconds may mean the difference between injury and serious injury or even death. It is anticipated that the application will benefit the safety of the elderly and children the most, but will also be beneficial to anyone that may have a slip and fall or a medical event that would require assistance in the shortest time possible.

RELATED ART

U.S. Pat. No. 2,829,913—North et al—Privacy Door Lock Assembly—discloses a push button locking mechanism for locking a bedroom or other door from the interior.

U.S. Pat. No. 4,861,084—Ozagir et al—Door Lock with Extra Release—discloses a door having a releasable door lock that can be unlocked from the outside for emergencies.

U.S. Pat. No. 4,866,965—Urdal—Panic Proof Passage Lock Set—discloses a lock set that can be opened from the outside using a coin or screwdriver.

U.S. Pat. No. 5,826,924—Huang—Lock Assembly With Emergent Forcible Unlatching From Outside—discloses a lock assembly including an inner handle that can be forcibly unlocked from the outside in an emergency.

U.S. Pat. No. 6,644,077—Huang—Lock Structure for Bathroom Use—discloses a lockset that prevents unintentional locking as a result of previous insufficient unlocking.

U.S. Pat. No. 7,832,309—Robins—Door Un-Locking Tool—discloses a tool capable of unlocking doors from the outside for use during emergencies or in the dark.

U.S. Pat. No. 7,525,411—Strader et al., a door lock is provided with a biometric sensor and a key cylinder. The biometric sensor is protected by being positioned on a shield, and such that the sensor is not exposed to damage by being on the front face of the door lock.

These publications and all other referenced patents are incorporated herein by reference in their entirety. Furthermore, where a definition or use of a term in a reference, which is an incorporated reference here, is inconsistent or contrary to the definition of that term provided herein the definition of the term provided herein applies and the definition of that term in the reference does not apply.

BRIEF SUMMARY OF THE INVENTION

The emergency access privacy lock can be used on interior doors such as bathrooms and bedrooms where a person may be at risk of locking themselves in. It enables the user to unlock the door from either side without the need for any tools. The invention has multiple embodiments that can be implemented on various lock types, for example, the present invention may be used in conjunction with locks that use a turning motion to lock the door (i.e., turn-to-lock type locks) and locks that use a pushing motion to lock the door (i.e., push-to-lock type locks). It will be appreciated that the term door as used herein includes any hinged closure and, in particular, room doors.

An object of this invention is to provide a complete safety lock for use on doors to allow access in case of an emergency or accidental locking of occupants inside rooms whilst otherwise providing security and privacy via the use of a privacy lock.

Another object of this invention is to provide kits for adapting locks that are already installed to allow access in case of an emergency or accidental locking of occupants inside rooms whilst otherwise providing security and privacy.

The present invention achieves its objects by providing an emergency access privacy lock. The manners in which the invention achieves its objects and other objects which are inherent in the invention will become more readily apparent when reference is made to the accompanying drawings wherein like number indicate corresponding parts throughout.

For the complete locksets, the emergency access safety function can be disabled during or after installation should a consumer prefer not to have the emergency access feature active

BRIEF DESCRIPTION OF THE FIGURES

In the following, embodiments of the present invention will be explained in detail on the basis of the drawings, in which.

DESCRIPTION OF THE PREFERRED EMBODIMENT

Figure 1:
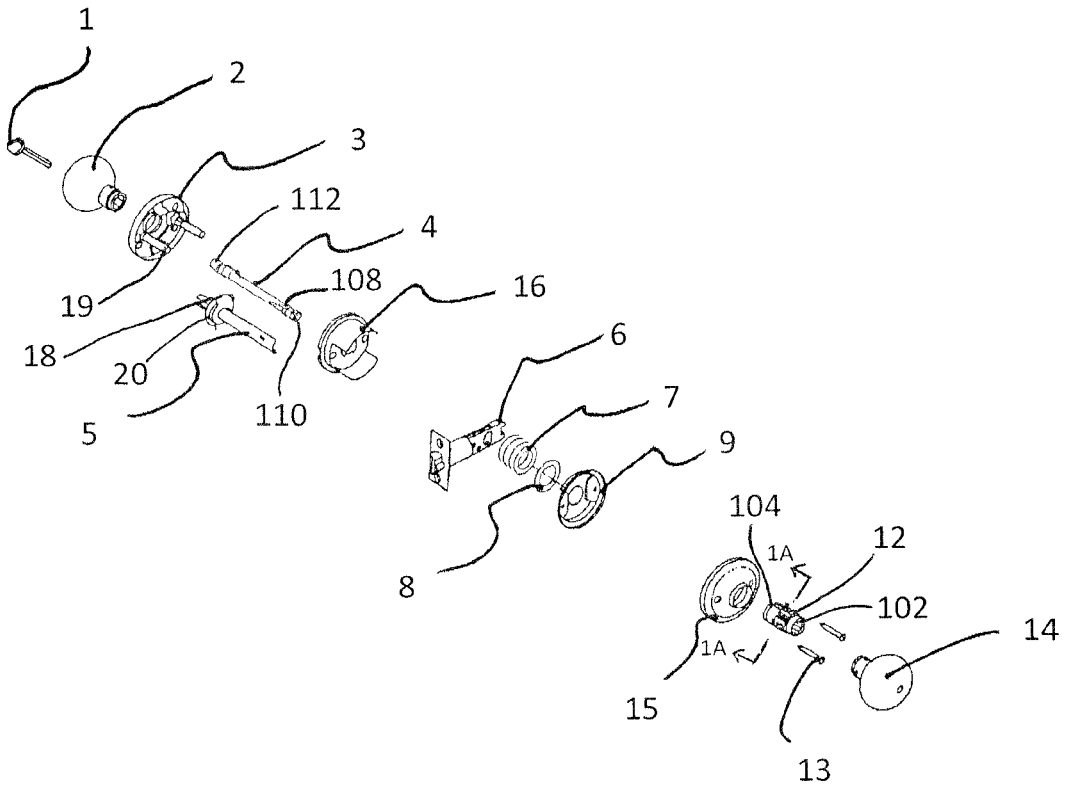
FIG. 1 is an exploded view of the turn to lock style emergency access privacy lock.

Referring now to the drawings wherein the showings are for purposes of illustrating a preferred embodiment of the present invention and not for purposes of limiting the same, according to a first embodiment of this invention there is a "turn-to-lock" style knob assembly (or "lockset" as referenced below) 10, see FIG. 1. From the inside of the door, the door can be locked with the standard thumb turn 1 found on all turn-to-lock style privacy locks. The interior knob 2 permanently houses the thumb turn 1. The interior knob 2 is mounted to a standard door via a rosette 3. The outside portion 100 of the lockset 10 will still function the same way as a traditional privacy lock in non-emergency situations. However, the exterior knob 14 is spring loaded and linearly biased in a direction away from the door in a manner allowing the user to push the exterior knob 14 linearly inwards, that is, along the longitudinal axis extending between the interior knob 2 and the exterior knob 14, towards the door. This linear movement of the exterior knob 14 results in the engagement and twisting of a fluted spindle 4 in manner causing rotation of the fluted spindle 4 about the longitudinal axis extending between the interior knob 2 and the exterior knob 14. As will be explained below in greater detail, because a first end 110 of the fluted spindle 4 is coupled to the exterior knob 14 via a knob insert 12 and the second end 112 of the fluted spindle 4 is coupled to the thumb turn 1, rotation of the fluted spindle 4 twists the thumb turn 1 thereby unlocking the door.

In conjunction with the twisting of the thumb screw 1 to unlock the door in accordance with the present invention, it should be appreciated the twisting of the thumb turn 1 has no significance in unlocking the door in this sentence. As those skilled in the art of locks will appreciate, the thumb turn 1 does turn when the lockset 10 is unlocked, but it is not the reason why the lockset 10 unlocks. Referring to FIG. 1, when the lockset 10 is locked, it is because the locking plate 18 on the spindle housing 5 is engaged with a screw post 19 of the rosette 3. When the fluted spindle 4 rotates, it slides the locking plate 18 within the spring cage 20 of the spindle housing 5, the locking plate 18 slides over to one side freeing it up from the screw post 19 allowing the whole spring cage 20 to rotate freely in either direction and the lockset 10 is now unlocked. Essentially the thumb turn 1 and fluted spindle 4 are doing the same thing, the only reason why the thumb turn 1 rotates when unlocked from the exterior side (when emergency push to unlock action is taken) is so that it is in the correct unlocked position once the user takes their hand off the lock.

The spring-loaded exterior knob 14 requires a necessary force of between a minimum of 7 to a maximum of 20+/− foot-pounds to cause movement of the exterior knob 14 linearly toward the door and along the longitudinal axis extending between the interior knob 2 and the exterior knob 14, in order to unlock the door in the manner described above so that a locked door cannot be easily unlocked and opened. In this embodiment the lock can still be unlocked using an emergency tool, such as the manufacturer provided tool or a small slot screwdriver.

In particular, the exterior portion 100 of this lockset 10 uses a return spring 7 to create the linear bias pushing the exterior knob 14 away from the door. The return spring 7 is housed between the latch 6 on one side and the knob keeper ring 8. The knob keeper ring 8 is further disposed on to the mounting plate 9 on the inside the door (not shown). The exterior knob 14 is mounted to the door in standard fashion with two mounting screws 13. The exterior knob 14 has a hollow knob insert 12 with the first end 102 of the knob insert 12 crimped to the inner surface 102 of the exterior knob 14. The second end 104 of the knob insert 12 abuts with the knob keeper ring 8 thereby transferring the spring bias of the return spring 7 to the knob insert 12 and ultimately to the exterior knob 14. The second end 104 of the knob insert 12 is hollow and is configured to receive the fluted spindle 4 so that when the exterior knob 14 is pushed in the second end 104 of the knob insert 12 engages the fluted spindle 4 causing the fluted spindle 4 to turn and slide the locking plate 18 within the spring cage 20 of the spindle housing 5, thereby causing the locking plate 18 to slide over to one side freeing it up from the screw post 19 and allowing the whole spring cage 20 to rotate freely in either direction (and the lockset 10 is now unlocked). Turning of the fluted spindle 4 is achieved based upon the interaction of the fluted spindle 4 with the knob insert 12. In particular, and as mentioned above, the fluted spindle 4 has a first end 110 configured for engagement with the knob insert 12 and a second end 112 coupled to the thumb turn 1.

Figure 1A:
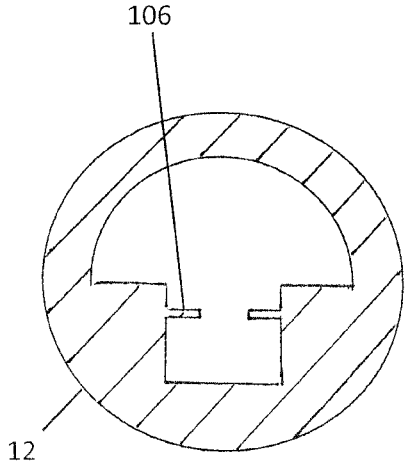
FIG. 1A is a cross sectional view along the line 1A-1A in FIG. 1.

The knob insert 12 is configured to slide through the exterior rosette 15 as it is moved when the exterior knob 14 is pushed toward the door. Referring to FIG. 1A, the knob insert 12 includes an engaging pin 106 between its first end 102 and its second end 104 in the middle of the knob insert 12. The fluted spindle 4 rests inside a spindle housing 5. The fluted spindle 4 is made from solid metal or appropriately durable material with an exterior groove 108 that can be characterized as helical or fluted in shape.

As the exterior knob 14 is pushed toward the door, the second end 104 of the knob insert 12, in which the fluted spindle 4 is received, slides across the fluted spindle 4, and the engaging pin 106 of the knob insert 12 contacts the groove 108 of the fluted spindle 4, which forces the fluted spindle 4 to rotate, thus unlocking the door. As mentioned above, the return spring 7, which allows unlocking from the outside, requires at least minimum of 7 and maximum of 20 foot-pounds+/− of force before it will engage. Once the exterior knob (or lever) 14 is depressed and the door is unlocked, it will return to its original position so that the door and exterior knob 14 can continue to be used as normal.

Figure 2:
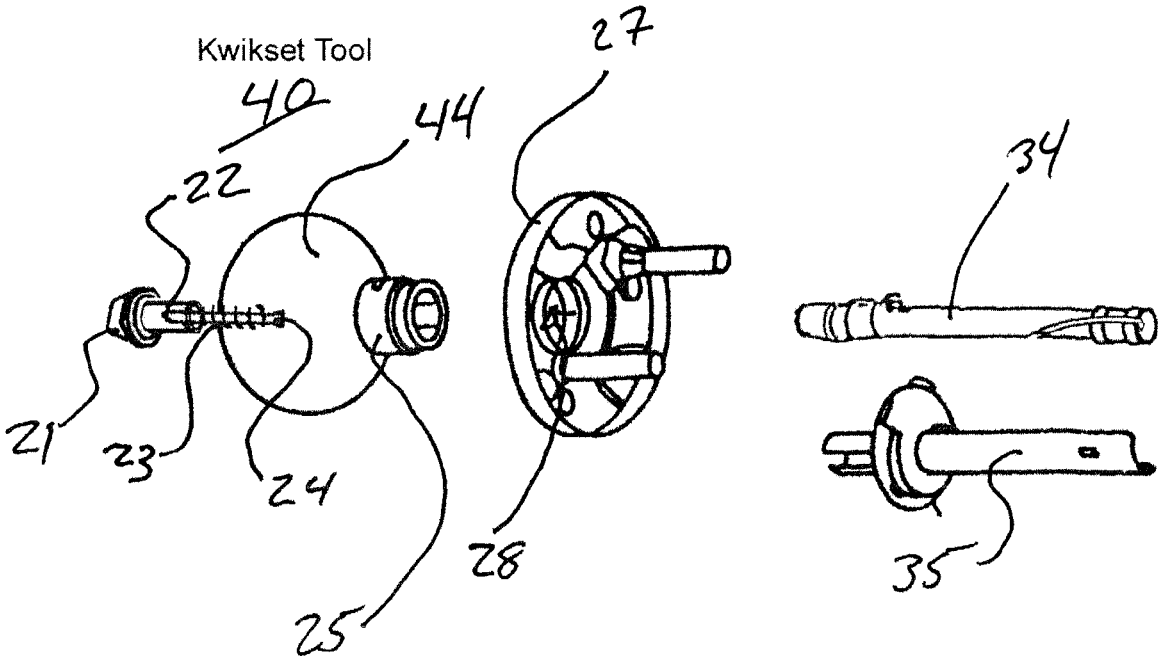
FIG. 2 is an exploded view of the turn to lock style emergency access privacy lock retrofit tool.

According to a second embodiment of this invention, the knob and door can be locked from the inside using the standard thumb turn found on all turn to lock style privacy locks, for example a Kwikset® privacy lock. FIG. 2 shows a kit 40 for adapting to existing installed door locks. The kit 40 portion comprises a thumb turn 21 attached to frictional mounting tube 22 and the frictional mounting tube 22 retains an activating pin 24. The frictional mounting tube 22 is designed to have a slight taper so that when the kit 40 is pushed into the existing emergency hole the kit will remain stably mounted therein. The activating pin 24 has a flat head shape and spring 23 that engages the proximal end of the spindle 34. When the thumb turn 21 is twisted, the activating pin 24 turns the spindle 34 to unlock the door. When the thumb turn 21 is twisted back to the locked position the door will be re-locked. The outside portion of the lock still functions as a traditional privacy lock in non-emergency situations, and the standard emergency tool can still be used to unlock the door.

Figure 4:
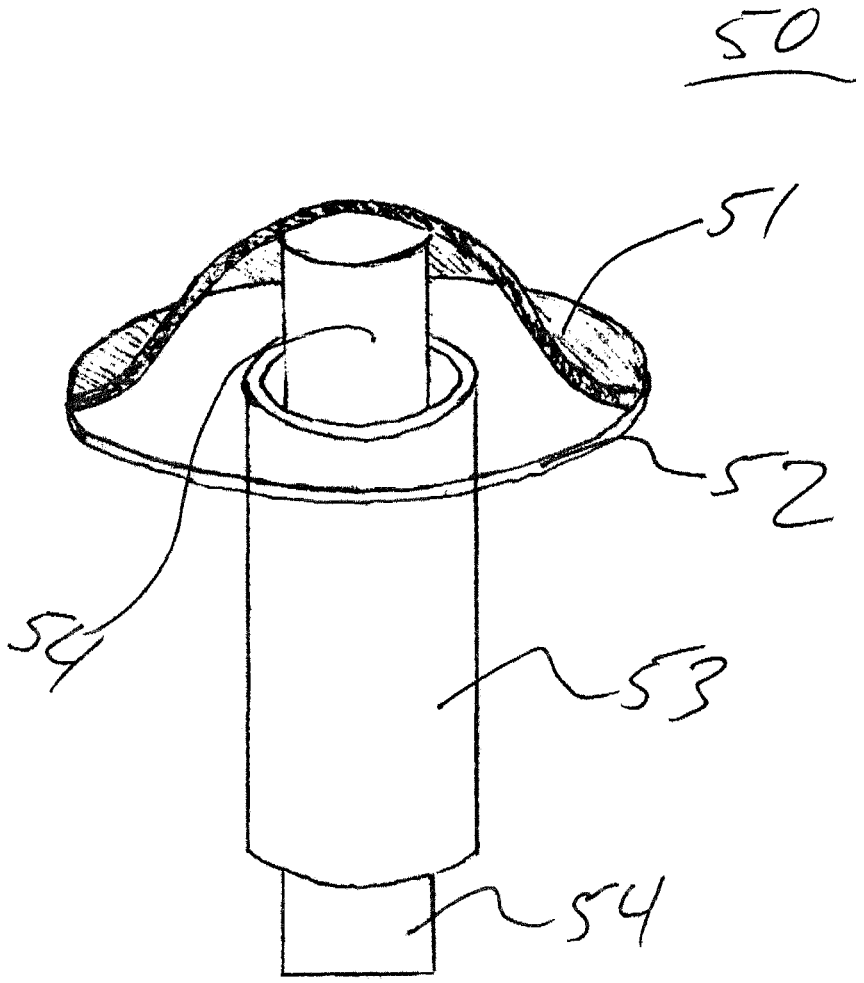
FIG. 4 is a close up cutaway view of the push to lock style emergency access privacy lock retrofit tool.

FIG. 4 discloses a similar third embodiment of a linear lock release kit 50 wherein an activating pin 54 is disposed within a frictional mounting tube 53, the frictional mounting tube 53 is pushed into the existing emergency tool-hole of an installed privacy lock. While the kit 50 is removable it is intended to remain permanently in place. The kit 50 further comprises a handle set seat 52 and a rubber dome 51 to cover the activating pin 54. The activating pin 54 engages the spindle (not shown) of a previously installed lock. The handle set seat 52 keeps frictional mounting tube 53 from shifting and can be comprised of any suitable material. The rubber dome 51 could be glued or attached to the activating pin 54 to return the activating pin to its original position after actuation. Alternatively, a return spring would return the activating pin 54 to its original position after actuation.

Figure 3:
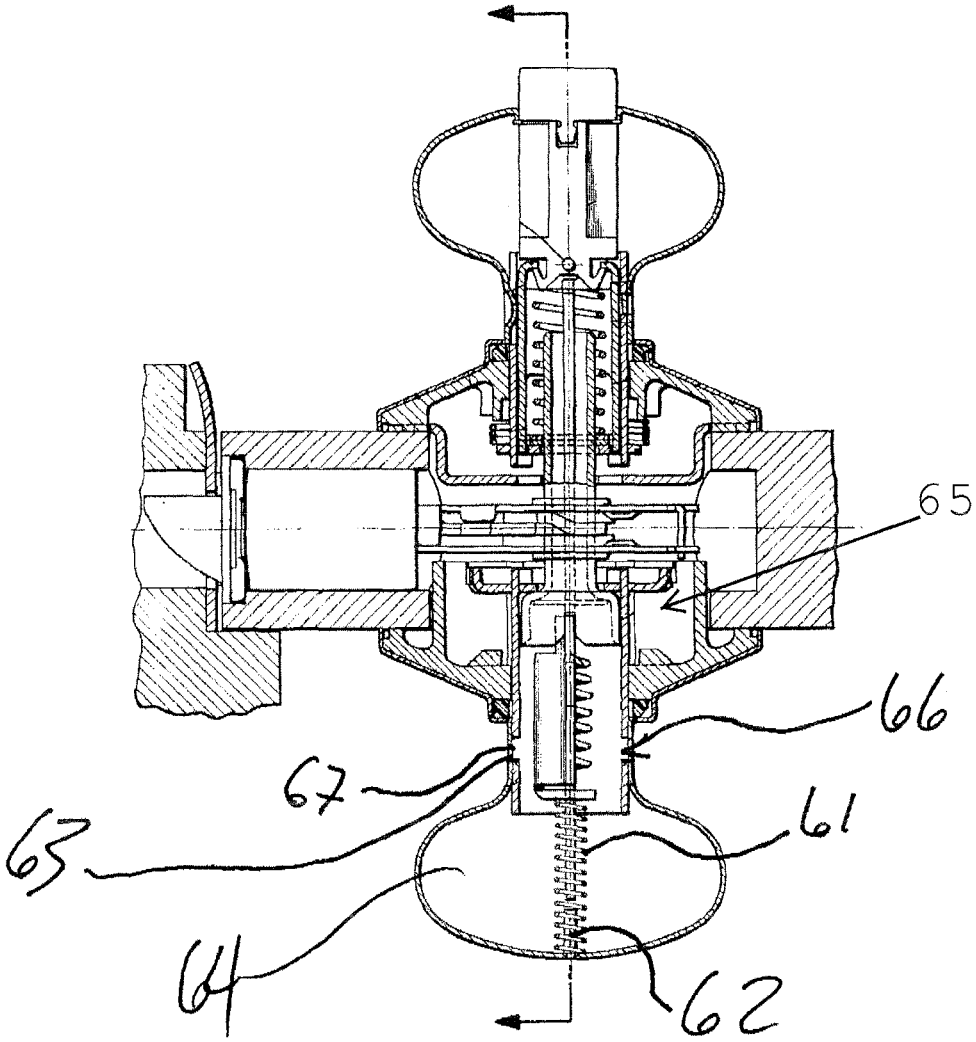
FIG. 3 is a cutaway view of the push to lock style emergency access privacy lock.

A fourth embodiment as shown in FIG. 3 shows a Schlage® like push button privacy lock adapted with a sliding knob 64 with an engaging tube 62 and engaging spring 61. Two keeper pins 63 allow the sliding knob 64 to slide in and out of the lock body 65 via narrow parallel slits 66 on the knob stem 67. The slits 66 and keeper pins 63 act together like rails to keep the knob 64 oriented with the axis between the two knobs of a lock. The parallel slits 66 are variable in length to accommodate actuation of various lock manufacturer designs and door thicknesses. The operator pushes the exterior knob 64 causing the engaging tube 62 to depress the spindle, thus unlocking the door.

In an alternative embodiment the lock incorporates biometric data analysis such as voice recognition, finger print, retinal scan, facial recognition, hand grip, and similarly known unique identifying details of a person. Biometric data would be utilized to set over ride the lock. For example, security settings could be incorporated to allow users to open the door based upon preprogramed settings. Much like a user account on a computer network, there could be an administrator account with the fullest access to the network, a user account could be used to override a more junior account, such as one for a child.

The foregoing descriptions are, at present, considered to be the preferred embodiments of the present invention. However, it is contemplated that various changes and modifications apparent to those skilled in the art, may be made without departing from the present discovery. Therefore, the foregoing description is intended to cover all such changes and modifications encompassed within the spirit and scope of the present discovery, including all equivalent aspects.

What is claimed is:

1. A kit for adapting to existing installed emergency access privacy locks wherein the kit is positioned within an inside portion of an emergency access privacy lock in case of an emergency or accidental locking of an occupant inside a room, and wherein an outside portion of the lock functions as a traditional privacy lock in non-emergency situations, the emergency access privacy lock including an exterior door knob and an interior door knob attached to opposing sides of a door for movement relative to the door for operating the emergency access privacy lock, the interior door knob including a conventional emergency hole providing access to a fluted spindle positioned between the exterior door knob and the interior door knob for movement causing a locking plate to slide within a spring cage of a spindle housing to control locking of the emergency access privacy lock, the kit comprising:

a thumb turn attached to a frictional mounting tube, the frictional mounting tube being sized to engage the emergency hole and having a slight taper so that when the frictional mounting tube is pushed into the emergency hole the frictional mounting tube will remain stably mounted therein, and wherein the frictional mounting tube retains an activating pin, which is fixedly secured to the thumb turn to rotate therewith, the activating pin having a flat head shape and a spring that engages a proximal end of the fluted spindle;

wherein when the thumb turn is twisted, the activating pin turns the spindle to unlock the emergency access privacy lock and when the thumb turn is twisted back to the locked position the emergency access privacy lock will be re-locked.

2. The kit according to claim 1, wherein the frictional mounting tube has a slight taper such that when the kit is pushed into an existing emergency hole the kit will remain stably mounted therein.

* * * * *